US007780012B2

(12) United States Patent
Prignon

(10) Patent No.: US 7,780,012 B2
(45) Date of Patent: Aug. 24, 2010

(54) CLASSIFIER FOR GRANULAR MATERIAL

(75) Inventor: Xavier Prignon, Evelette (BE)

(73) Assignee: Magotteaux International S.A. (BE)

( * ) Notice: Subject to any disclaimer, the term of this patent is extended or adjusted under 35 U.S.C. 154(b) by 0 days.

(21) Appl. No.: 10/586,236

(22) PCT Filed: Dec. 8, 2004

(86) PCT No.: PCT/BE2004/000173

§ 371 (c)(1),
(2), (4) Date: Jul. 17, 2006

(87) PCT Pub. No.: WO2005/075115

PCT Pub. Date: Aug. 18, 2005

(65) Prior Publication Data

US 2007/0163925 A1 Jul. 19, 2007

(30) Foreign Application Priority Data

Feb. 4, 2004 (EP) ..... 04447026

(51) Int. Cl.
*B07B 7/00* (2006.01)
*B07B 7/04* (2006.01)
*B04C 5/00* (2006.01)

(52) U.S. Cl. ..... 209/139.1; 209/715; 209/716; 209/719; 209/720; 209/723

(58) Field of Classification Search ..... 209/139.1, 209/715, 718–723, 152
See application file for complete search history.

(56) References Cited

U.S. PATENT DOCUMENTS 1,746,686 A * 2/1930 Sturtevant ..... 209/139.2
4,551,241 A 11/1985 Saverse et al.
4,661,244 A * 4/1987 Hanke et al. ..... 209/139.2
4,792,393 A * 12/1988 Blasczyk et al. ..... 209/135
4,869,786 A * 9/1989 Hanke ..... 209/139.2

(Continued)

FOREIGN PATENT DOCUMENTS

DE 1 407 270 1/1969

(Continued)

OTHER PUBLICATIONS

International Search Report, International Application No. PCT/BE2004/000173, date of actual completion of the international search Mar. 30, 2005, date of actual mailing of the international search report Apr. 14, 2005, 2 pages.

(Continued)

*Primary Examiner*—Gene Crawford
*Assistant Examiner*—Terrell H Matthews
(74) *Attorney, Agent, or Firm*—Reinhart Boerner Van Deuren P.C.

(57) ABSTRACT

The present invention relates to a dynamic air classifier for the separation of granular and powdery materials into fractions of different grain sizes comprising a rotary cage, wherein:

said classifier also comprises a recovery chamber for fine materials with a outlet bottom, said chamber being defined by a casing;

said recovery chamber is coaxially arranged in the protrusion of the rotary cage so as to be able to use the vortex created by the rotary cage for cycloning said material;

said recovery chamber comprises openings in the casing allowing the passage of the centrifuged material towards ducts for collecting the material located outside the chamber.

21 Claims, 2 Drawing Sheets

U.S. PATENT DOCUMENTS

| | | | | |
|---|---|---|---|---|
| 5,091,077 | A * | 2/1992 | Williams | 209/23 |
| 5,232,096 | A * | 8/1993 | Weit | 209/135 |
| 6,739,456 | B2 * | 5/2004 | Svoronos et al. | 209/725 |

FOREIGN PATENT DOCUMENTS

| | | |
|---|---|---|
| EP | 0 023 320 | 2/1981 |

OTHER PUBLICATIONS

Written Opinion of the International Searching Authority, International Application No. PCT/BE2004/000173, date of actual completion of the corresponding international search Mar. 30, 2005, date of actual mailing of the corresponding international search report Apr. 14, 2005, 4 pages, European Patent Office.

* cited by examiner

Prior Art

CLASSIFIER FOR GRANULAR MATERIAL

CROSS-REFERENCE TO RELATED PATENT APPLICATION

This patent application is the National Stage of International Application No. PCT/BE2004/000173 filed Dec. 8, 2004, which claims the benefit of EP 04447026.8 filed Feb. 4, 2004, the teachings and disclosure of which are hereby incorporated in their entireties by reference thereto.

FIELD OF THE INVENTION

The present invention relates to the separation of granular materials, and in particular to the classification of powders or similar materials by means of a dynamic air classifiers.

STATE OF THE ART

The separation of granular and powdery materials into two fractions with different grain sizes may be achieved by means of dynamic air classifiers. The materials concerned are powders with particle sizes of up to 1,000 μm such as cement, limestone or lime, ore and coal dust, among others.

The capacities of material treated vary from a few tonnes to several hundreds of tonnes per hour.

Dynamic classifiers have undergone several major changes allowing to classify them into three large groups. The first generation, generally known by the names of "turbo," "heyd" or "whirlwind", has been improved by the second generation of the "wedag" type.

The 3$^{rd}$ generation is the most effective from the point of view of the separation efficiency. The operating principle of classifiers (O'Sepa, Sturtevant SD, . . . ) is described in documents U.S. Pat. No. 4,551,241 and EP 0 023 320.

Document U.S. Pat. No. 4,551,241 discloses a particle classifier provided with a lateral cyclone into which the particles are brought and cycloned. The surplus is sent to the rotary cage of the classifier. The whole installation proves relatively bulky and of quite complex design.

Document EP 0 023 320 also shows a device for the classification of granular materials with a lateral outlet for the air charged with fine particles. This installation requires the use of additional filters and/or cyclones for the separation of fine materials.

AIMS OF THE INVENTION

The present invention aims to disclose a dynamic air classifier allowing to avoid the use of external filters or cyclones, the recovery of the fine materials occurring in the body of the classifier itself.

The present invention also relates to a method of separation according to grain size using the classifier of the invention.

SUMMARY OF THE INVENTION

The present invention discloses a dynamic air classifier for the separation of granular and powdery materials into grain size fractions, comprising a rotary cage in which:

- said classifier also comprises a recovery chamber 2 for fine materials with a outlet bottom, said chamber 2 being defined by a casing;
- said recovery chamber 2 is coaxially arranged in the protrusion of the rotary cage 1 so as to be able to use the vortex created by the rotary cage for cycloning said material;
- said recovery chamber 2 comprises openings in the casing 5 allowing the passage of the centrifuged material towards the collection ducts for the material located outside the chamber.

In addition, according to the invention, said recovery chamber 2 may comprise fixed and/or mobile deflectors (4,7) in order to modify the air velocity and/or to change its direction.

According to a preferred embodiment of the invention, said recovery chamber 2 for the fine materials is cylindrical or cone-shaped, the cone possibly being open at the top or at the bottom.

As an advantage, said recovery chamber 2 for the fine materials has a length that corresponds to 2 to 6 times the length of the rotary cage 1 so as to have the required and sufficient cycloning capacity.

In an especially preferred manner, said recovery chamber 2 for the fine materials and said rotary cage 1 share the same vertical axis as the recovery chamber 2 positioned below and protruding from said cage 1.

According to a first embodiment of the invention, the deflectors 4 that are positioned in the outlet part of the rotary cage 1 and/or in the recovery chamber 2 are driven by the rotation means of the cage 1 or by a separate device.

According to a second embodiment of the invention, the deflectors 4 that are positioned in the outlet part of the rotary cage 1 are attached to said cage 1 itself.

The invention also specifies that the air-extraction duct 3 passes through the outlet bottom of the recovery chamber 2, said duct having a diameter of between 30 and 95% of the bottom diameter of the recovery chamber 2 for the fine materials.

Several openings and/or slits are preferably provided at the bottom of the recovery chamber 2.

In addition, below said slits and/or openings there are a plurality of ducts 8 leading to a means for conveying the material.

As an advantage, below said slits and/or openings there are a plurality of ducts 8 leading to a circular airslide conveying the material towards another means of conveyance.

The classifier of the invention is also characterised by the presence of one or several deflectors 7 that are conical, cylindrical or radial (angled or straight) on top of the bottom of the recovery chamber 2, outside the air-extraction duct 3, so as to minimise the turbulence near the bottom of the chamber and to avoid that the material is picked up again by the air.

In addition, the invention also shows the presence of a plurality of openings in the lower part of the casing 5 of the recovery chamber 2, these openings leading into collection ducts for the fine material may be appropriately positioned (not shown).

The present invention also discloses a method of separation according to grain size by means of a dynamic air classifier, comprising the following steps:

- feeding the material to be treated 13 to the rotary cage 1;
- sorting between large and fine particles in the rotary cage 1 depending on the rotation velocity and air intake;
- rejecting the large particles to the refuse chamber 17.
- recovering the fine materials in the recovery chamber 2 positioned coaxially with the rotary cage;
- using the vortex created by the rotary cage and possibly further accelerated by mobile or fixed deflectors 4 for cycloning the fine material;
- separating the dedusted air and fine particles and extraction of the latter to a means of conveyance.

Lastly, the invention discloses the use of the device described in claim 1 for the separation and classification of particles of mineral materials such as particles of cement, clinker, lime and coal dust.

DESCRIPTION OF THE INVENTION

Figure 1:
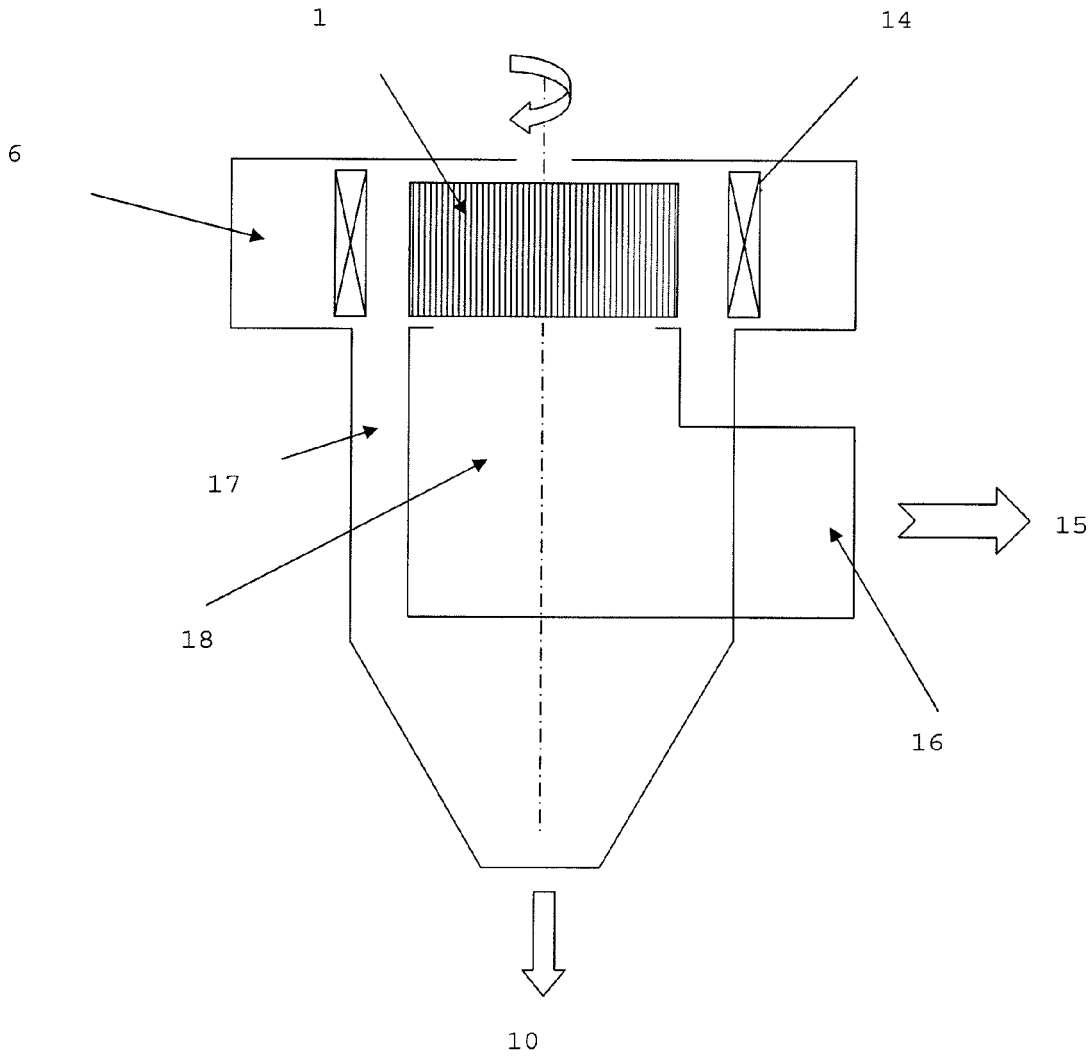
FIG. 1 shows the layout of a classifier of the 3rd generation as in the state of the art.

All types of classifier operate according to the same principle, which is shown in FIG. 1. The heart of the classifier comprises a squirrel cage 1 rotating about a vertical axis. This cage comprises spaced plates or bars and is surrounded by vanes 14 allowing to direct the air before it enters through the intake volute 6 in the cage 1. Vanes 14 may also assist with controlling the airflow.

The material to be separated enters the sorting zone defined by the outside of the cage 1 and the deflectors 4. The maximum size of the particles entering the cage with the air will be determined by the rotation velocity of the cage 1 and the volume of air with which the classifier is fed.

The larger particles remain outside the cage and are collected in the refuse chamber 17. These large particles come out of the classifier by gravity 10. The air charged with fine particles 15 comes out of the cage either through the top or laterally and it leaves the classifier by a duct. The fine material is then recovered by means of one or more cyclone(s) or filter(s) outside the body of the classifier.

In modern classifiers of the 3rd generation, the air enters the cage 1 with a tangential velocity of the same order as the peripheral velocity of the cage. The tangential component of the velocity naturally increases when the air enters inside the cage 1 (vortex effect).

Figure 2:
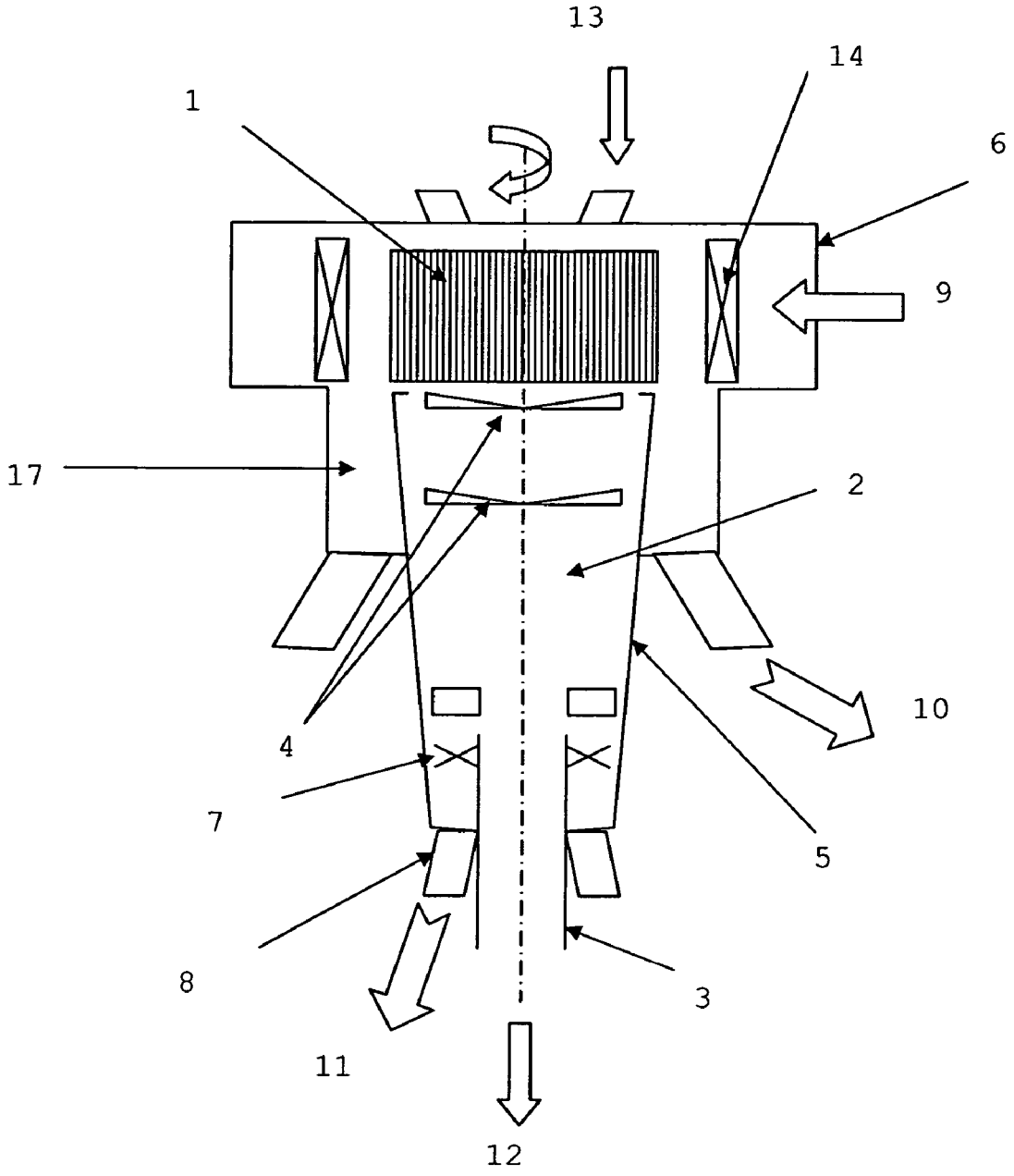
FIG. 2 shows the principle layout of the classifier as in the invention.

The principle of the invention is laid out in FIG. 2. This consists in using the vortex already created in order to cyclone the material to be treated 13 in a recovery chamber 2 adjacent to and coaxial with the cage 1, the dedusted air 12 leaving this recovery chamber 2 through an air-extraction duct 3 whose intake is located inside the recovery chamber 2. The dedusted air 12 is then sucked towards one or several ventilators that send some of the air or all of it back to the air-intake volute 6 of the classifier.

The vortex created by the rotary cage 1 may either remain free or be accelerated by fixed or mobile deflectors 4 before entering said recovery chamber 2. These deflectors 4 may also be positioned in the recovery chamber 2 itself.

The fine material 11 is centrifuged in this recovery chamber 2 and it will concentrate in the outer part of the chamber where it will be collected by means of openings in the walls (cylindrical casing and/or bottom) of the recovery chamber 2.

The recovery efficiency for the fine materials 11 essentially depends on the size of the particles and of their absolute density. For a same material, the important factors are the intensity of the vortex, i.e. the tangential velocity of the air all through the recovery chamber 2, the diameter of the recovery chamber 2 and the dwelling time of the particles in said chamber.

In other words, the important factors will be the diameter of the recovery chamber 2, its length and the tangential velocity of the air. The greater the tangential component of the air and the longer the chamber, the greater will be the recovery efficiency.

The invention thus comprises a classifier with a cage, provided with a recovery chamber 2 for fine materials which is fitted coaxially in the protrusion of the rotary cage 1. This recovery chamber for fine materials is cylindrical or conical (cone-shaped), the angle of the cone generating line with the revolution axis of the cone preferably being smaller than 30°; the intake diameter of the recovery chamber 2 for fine materials is of the same size order as the diameter of the cage 1 and has a length that corresponds to 2 to 6 times the length of the cage 1.

In the outlet area of the cage 1 and/or in the recovery chamber 2, fixed or mobile deflectors 4 may be installed and will allow to affect the direction of the air currents. The possible rotation of these deflectors 4 may be induced by attaching them to the cage 1 or on the other hand by setting them in motion by a means that is independent of the cage 1. They may also be set in motion by the same means as the cage 1 without being attached to said cage 1.

The extraction duct 3 for the dedusted air 12 will be on its first part concentric of the recovery chamber and will preferably have a diameter between 0.3 and 0.95 times the bottom diameter of the recovery chamber 2 in the plane of the intake surface of said duct. Outlet deflectors 7 may be positioned here so as to control the direction of air intake at the inlet of the duct.

Recovery of the centrifuged material occurs by using openings at the outlet bottom and/or in the lower half of the casing 5 of the recovery chamber 2. Sleeves or ducts 8 for the material are provided opposite these openings so as to collect and direct the material towards traditional means of conveyance.

The use of a coaxial recovery chamber in the protrusion of the rotary cage allows to use the vortex already created by the cage and thereby reduces the losses of charge of the aeraulic circuit.

The invention allows to avoid the use of filters or cyclones external to the machine, thus simplifying its installation. An additional advantage is that the entire separation assembly is more compact, which reduces the engineering work of installation, reduces the installation costs and reduces charge losses in the separation circuit.

Key

1. Classifier with rotary cage
2. Recovery chamber for fine materials
3. Air-extraction duct
4. Fixed or mobile deflectors
5. Casing of the recovery chamber
6. Air-intake volute
7. Outlet deflectors
8. Material duct
9. Intake air
10. Coarse material separated by gravity
11. Fine material
12. Dedusted air
13. Material to be treated
14. Vanes
15. Air and fine material
16. Air-outlet duct
17. Refuse chamber (large material)
18. Fine material chamber

The invention claimed is:

1. A dynamic air classifier for separation of granular and powdery materials into fractions of different grain sizes comprising:

a rotary cage (1) adapted to create a vortex when subjected to air flow, the rotary cage (1) classifying the materials into fine particles and coarse particles;

a recovery chamber (2) having an outlet bottom, said recovery chamber (2) being defined by a casing (5), wherein the recovery chamber (2) receives the fine particles mixed with air from the rotary cage (1);

said recovery chamber (2) coaxially arranged in a protrusion of the rotary cage (1), the recovery chamber (2) adapted to use the vortex created by the rotary cage for cycloning the fine particles mixed with air and separating the fine particles from air; and said recovery chamber (2) including a fine particles outlet and an air outlet, wherein the fine particles separated from air exit through the fine particles outlet and a dedusted air exits through the air outlet.

2. The dynamic air classifier as in claim 1, wherein said recovery chamber (2) comprises fixed and/or mobile deflectors (4,7).

3. The dynamic air classifier as in claim 1, wherein said recovery chamber (2) for fine materials is cylindrical or cone-shaped, wherein the recovery chamber (2) is open to the rotary cage (1) at an inlet and includes at least two separate openings on the outlet bottom, wherein the at least two separate openings define the fine particles outlet and the air outlet.

4. The dynamic air lassifier as in claim 1, wherein said recovery chamber (2) has a length that corresponds to 2 to 6 times the length of the rotary cage (1).

5. The dynamic air classifier as in claim 1, wherein said recovery chamber (2) and said rotary cage (1) share the same vertical axis, the recovery chamber (2) being positioned below and protruding from said cage (1).

6. The dynamic air classifier as in claim 1, wherein the deflectors (4) that are positioned in the outlet part of the rotary cage (1) and/or in the recovery chamber (2) are driven by the rotation means of the cage (1) or by a separate device.

7. The dynamic air classifier as in claim 1, wherein the deflectors (4) that are positioned in the outlet part of the rotary cage (1) are attached to said cage (1) itself.

8. The dynamic air classifier as in claim 1, wherein an air-extraction duct (3) passes through the outlet bottom of the recovery chamber (2), said duct having a diameter between 30 and 95% of the bottom diameter of the recovery chamber (2).

9. The dynamic air classifier as in claim 1, wherein a plurality of openings and/or slits are provided at the bottom of the recovery chamber (2).

10. The dynamic air classifier as in claim 9, wherein there are a plurality of ducts (8) below said slits and/or openings, leading to a means for conveying the material.

11. The dynamic air classifier as in claim 9, wherein there are a plurality of ducts (8) below said slits and/or openings, leading to a circular airslide conveying the material to another means of conveyance.

12. The dynamic air classifier as in claim 1, wherein the recovery chamber (2) includes at least one deflector (7) proximate the outlet bottom of the recovery chamber (2), outside of an air-extraction duct (3), wherein the at least one deflector (7) minimises the turbulence near the bottom of the chamber and preventing the fine particles from being picked up again by the air.

13. The dynamic air classifier as in claim 1, wherein the casing (5) of the recovery chamber (2) includes a plurality of openings in a lower portion of the casing (5), at least one of the plurality of openings leading to the ducts for collecting the fine particles.

14. A method of separation according to grain sizes by means of a dynamic air classifier, comprising the following steps:

feeding the material to be treated (13) to the rotary cage (1);

sorting between large and fine particles in the rotary cage (1) depending on the rotation velocity and air intake;

rejecting the large particles towards the refuse chamber (17);

recovering the fine materials in the recovery chamber (2) positioned coaxially with the rotary cage;

using the vortex created by the rotary cage and possibly further accelerated by mobile or fixed deflectors (4) for cycloning the fine material;

separating the dedusted air and the fine particles and extraction of the latter to a means of conveyance.

15. The dynamic air classifier as in claim 1, further comprising a central opening between the rotary cage (1) and the recovery chamber (2), intersecting an axis directly connecting the rotary cage (1) and the recovery chamber (2) so that the recovery chamber (2) uses the vortex created by the rotary cage (1).

16. The dynamic air classifier as in claim 15, wherein no intervening structure is disposed along the axis between the rotary cage (1) and the recovery chamber (2).

17. The dynamic air classifier as in claim 1, wherein the rotary cage (1) comprises a vortex creation apparatus and the recovery chamber (2) is free of any vortex creation apparatus.

18. The dynamic air classifier as in claim 1, wherein the rotary cage includes at least one coarse particles outlet, wherein the coarse particles exit the rotary cage through the at least one coarse particles outlet and the fine particles mixed with air enter the recovery chamber.

19. A dynamic air classifier comprising:

a material inlet receiving materials including coarse particles and fine particles;

a rotary cage including a vortex creation apparatus to generate a vortex, the rotary cage including a classifier classifying the coarse particles from the fine particles;

a coarse particle outlet allowing collection of the classified coarse particles from the rotary cage;

a recovery chamber vertically arranged under the rotary cage, the recovery chamber receiving the classified fine particles mixed with air from the rotary cage with the classified fine particles mixed with air continuing to swirl in the vortex from the rotary cage through the recovery chamber;

wherein the recovery chamber includes at least one deflector and uses the vortex created by the rotary cage to cyclone and separate fine particles from air;

wherein the recovery chamber includes a fine particle outlet and an air outlet, the fine particle outlet coaxially arranged with the air outlet, wherein the fine particle outlet circumscribes the outer periphery of the air outlet, wherein the fine particles separated from air is recovered through the fine particle outlet and a dedusted air exit through the air outlet.

20. The dynamic air classifier of claim 19, wherein the recovery chamber is attached directly to the rotary cage, wherein the rotary cage and the recovery chamber are arranged without any intervening structure between them, thereby allowing the recovery chamber to utilize the vortex generated by the rotary cage, wherein the recovery chamber is free of any vortex creation apparatus and adapted to separate the fine particles from air and recover the fine particles without need of any external filters or cyclones.

21. The dynamic air classifier of claim 19, wherein the recovery chamber is cylindrical or conical, wherein the recovery chamber is conical, an angle of a cone generating line with a revolution axis of the cone is less than 30° , wherein a length of the recovery chamber is between 2 to 5 times a length of the rotary cage.

* * * * *